US010309186B2

(12) United States Patent
Carmody et al.

(10) Patent No.: US 10,309,186 B2
(45) **Date of Patent: *Jun. 4, 2019**

(54) OPEN-HOLE MECHANICAL PACKER WITH EXTERNAL FEED THROUGH RUN UNDERNEATH PACKING SYSTEM

(71) Applicant: Baker Hughes, a GE company, LLC, Houston, TX (US)

(72) Inventors: Michael Carmody, Houston, TX (US); Clifford T Frazee, Katy, TX (US); Wayne Furlan, Cypress, TX (US); Matthew Krueger, Cypress, TX (US); Frank Maenza, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/722,271

(22) Filed: Oct. 2, 2017

(65) Prior Publication Data

US 2019/0100976 A1 Apr. 4, 2019

(51) Int. Cl.

| | |
|---|---|
| ***E21B 33/12*** | (2006.01) |
| ***E21B 17/02*** | (2006.01) |
| *E21B 33/00* | (2006.01) |

(52) U.S. Cl.

CPC ..... *E21B 33/1208* (2013.01); *E21B 17/023* (2013.01); *E21B 2033/005* (2013.01)

(58) Field of Classification Search

CPC ..... E21B 33/128; E21B 33/1208
USPC ..... 166/379
See application file for complete search history.

(56) References Cited

U.S. PATENT DOCUMENTS

| | | | | |
|---|---|---|---|---|
| 2,253,092 | A | 8/1941 | Pranger | |
| 3,899,631 | A | 8/1975 | Clark | |
| 6,173,788 | B1 | 1/2001 | Lembcke et al. | |
| 7,431,082 | B2 | 10/2008 | Holt et al. | |
| 7,611,339 | B2 | 11/2009 | Tetzlaff et al. | |
| 7,762,322 | B2 | 7/2010 | Andersen et al. | |
| 7,836,960 | B2 | 11/2010 | Patel et al. | |
| 8,083,000 | B2 | 12/2011 | Nutley et al. | |
| 8,215,394 | B2 | 7/2012 | Cascario et al. | |
| 8,459,367 | B2 | 6/2013 | Nutley et al. | |
| 2010/0230094 | A1* | 9/2010 | Foster | E21B 33/1208 166/179 |
| 2014/0014373 | A1* | 1/2014 | Richards | E21B 17/026 166/385 |
| 2015/0226023 | A1* | 8/2015 | Scruggs | E21B 47/12 166/250.1 |

OTHER PUBLICATIONS

Easywell; Halliburton Feedthrough Technology, Swellpacker Cable System, Achieve Complete Zonal Isolation in Intelligent Wells and Reduce Completion Costs Oct. 2007.

* cited by examiner

*Primary Examiner* — Taras P Bemko
(74) *Attorney, Agent, or Firm* — Parsons Behle & Latimer

(57) ABSTRACT

A mechanically-set packer system for use in a wellbore environment may include a mandrel having an interior and an exterior. The system may further include a packing element positioned along the exterior of the mandrel. The system may also include a line positioned between the exterior of the mandrel and an interior of the packing element.

23 Claims, 5 Drawing Sheets

OPEN-HOLE MECHANICAL PACKER WITH EXTERNAL FEED THROUGH RUN UNDERNEATH PACKING SYSTEM

CROSS-REFERENCE TO RELATED APPLICATIONS

This application is related to U.S. patent application Ser. No. 15/722,160 filed on Oct. 2, 2017, and entitled "Open-Hole Mechanical Packer with External Feed Through and Racked Packing System," and U.S. patent application Ser. No. 15/722,197 filed on Oct. 2, 2017, and entitled "Locking Keyed Component for Downhole Tool," the contents of each of which are hereby incorporated by reference in their entirety.

FIELD OF THE DISCLOSURE

The disclosure is related to the field of mechanically-set packers and more particularly to mechanically-set packers with external feed throughs run underneath packing elements.

BACKGROUND

In open-hole wellbore operations, a packer assembly system may sometimes be used to create a seal between an uphole portion of a wellbore and a downhole portion of the wellbore in order to enable operations to be performed by one or more tools on a string within the downhole portion. Mechanically-set packer assembly systems may rely on non-swellable materials that are expanded by mechanical means, as opposed to swelling means, to form a seal with a wall of the wellbore. Any interruptions between a packing element, or a sealing element, of the packer assembly system and the wellbore wall may prevent proper sealing and may adversely affect operations in the wellbore.

A typical packer assembly system may not provide accommodations for communication lines and/or control lines to be inserted within the packer system. If accommodations are provided, in a typical packer assembly, the line may be run either through the packing element, through an exterior of the packer assembly system, or through a drilled hole in the mandrel, which may result in the packer assembly not sealing completely when set within a wellbore. Some packer assemblies may rely on swellable materials to try to reduce this potential problem. However, in a mechanically set packer assembly, swellable materials may not be compatible with a packing or sealing element. Hence, in mechanically-set packer systems, it may be difficult to pass communication lines through the packer assembly. Packer assemblies that provide a line through either the packing element, an exterior of the packer assembly, or through the mandrel typically require splicing the communication line and/or control line above and below the packer assembly. Splicing enables an uphole portion of the line to be connected to a bridging communication line that is pre-installed through the packing system, which is in turn connected to a downhole portion of line. Splicing is a complex operation that may increase the resources necessary to run a packer system into a wellbore. Further, splices in a communication line and/or a control line may significantly degrade signal quality and may, therefore, adversely affect operations within the wellbore. Also, splices in the line may present a weak point, which may affect the integrity of the seal provided by the packer. Other disadvantages may exist.

SUMMARY

The present disclosure is directed a packer system for use in a wellbore. The packer system may be positioned along a string and includes a line that traverses the packer system along the string without the use of splices.

In an embodiment, a mechanically-set packer system for use in a wellbore environment includes a mandrel having an interior and an exterior. The system further includes a packing element positioned along the exterior of the mandrel. The system also includes a line positioned between the exterior of the mandrel and an interior of the packing element.

In some embodiments, the packing element is formed of a non-swellable material. In some embodiments, the non-swellable material includes a metallic material, an elastomeric material, or a thermoplastic material. In some embodiments, the packing element includes a cut to enable the line to be installed within the interior of the packing element. In some embodiments, the system includes a longitudinal recess in the exterior of the mandrel, the longitudinal recess configured to receive the line therein. In some embodiments, the system includes a cover positioned over at least a portion of the line positioned between the exterior of the mandrel and the interior of the packing element, the cover formed of a non-swellable material. In some embodiments, the line is a pneumatic line, an electrical line, or an optical line. In some embodiments, the line is continuous, without splices, from a surface location to a tool, the packing element being located between the surface location and the tool. In some embodiments, the mandrel has a first end and a second end and wherein the line is continuous, without splices, from the first end to the second end.

In some embodiments, the system includes at least one gauge ring positioned on the exterior of the mandrel, the at least one gauge ring connected to a first end of the packing element, the line positioned through a gap in the at least one gauge ring. In some embodiments, the system includes at least one C-ring positioned on the exterior of the mandrel, the at least one C-ring connected to a second end of the packing element the line positioned through a gap in the at least one C-ring. In some embodiments, the wellbore environment is an open-hole wellbore.

In an embodiment, a mechanically-set packer system for use in a wellbore environment includes a mandrel having an interior and an exterior. The system further includes a packing element positioned on the exterior of the mandrel. The mandrel and the packing element are configured to receive a line between the exterior of the mandrel and an interior of the packing element.

In some embodiments, the packing element is formed of a non-swellable material. In some embodiments, the non-swellable material includes a metallic material, an elastomeric material, or a thermoplastic material. In some embodiments, the packing element includes a cut to enable the line to be installed within the interior of the packing element. In some embodiments, the system includes a longitudinal recess in the exterior of the mandrel, the longitudinal recess configured to receive the line therein. In some embodiments, the system includes a cover positioned over at least a portion of the line positioned between the exterior of the mandrel and the interior of the packing element, the cover formed of a non-swellable material.

In an embodiment, a mechanically-set packer system for use in a wellbore environment includes a mandrel having an interior and an exterior. The system also includes a packing element positioned along the exterior of the mandrel. The system further includes a sleeve formed of a non-swellable material and configured to cover at least a portion of a surface of a line. The packing element is configured to receive the line and the protective sleeve therethrough, the protective sleeve forming a seal with the packing element. The sleeve formed of a non-swellable material may also be used in embodiments where the line is positioned between an exterior of the mandrel and an interior of the packing element. In some embodiments, the mandrel has a first end and a second end and wherein the line is continuous, without splices, from the first end to the second end.

Figure 1:
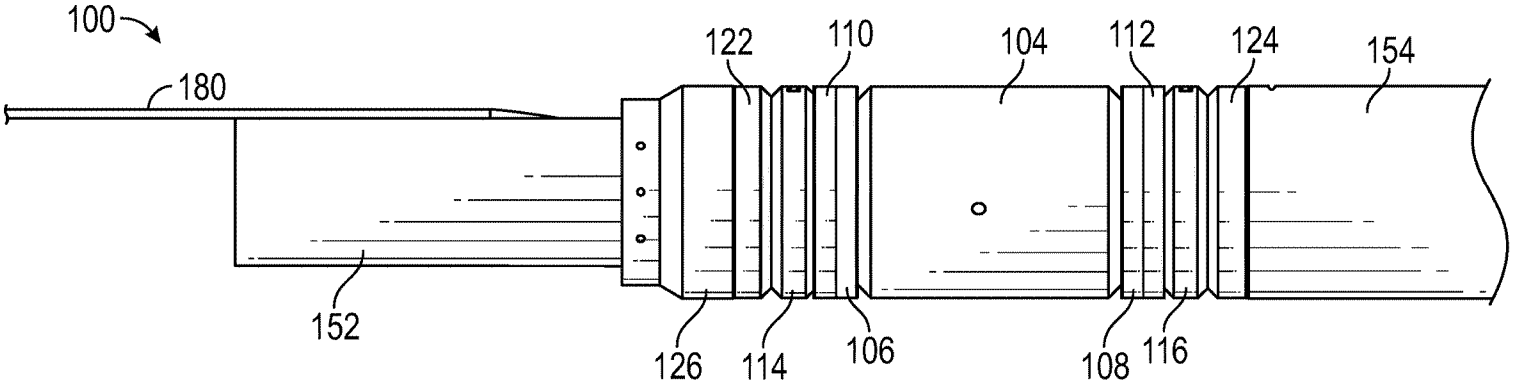
FIG. 1 is a schematic drawing depicting a side view of an embodiment of a mechanically-set packer system for use in a wellbore.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure.

DETAILED DESCRIPTION

Referring to FIG. 1, a side view of an embodiment of a mechanically-set packer system 100 for use in a wellbore is depicted. As discussed in the above related patent applications entitled "Open-Hole Mechanical Packer with External Feed Through and Racked Packing System" and "Locking Keyed Components for Downhole Tools," it may be beneficial to run a continuous line, such as line 180 shown in FIG. 1, down a work or tubing string that does not require splices to traverse the string. The line 180 may provide communication with a downhole location, control of a downhole device, or both as would be appreciated by one of ordinary skill in the art having the benefit of this disclosure. As the line 180 travels along the string it may need to bypass the seal made by the packer system 100.

The packer system 100 may include a packing element 104. The packing element 104 may be suitable for mechanically-set packing. As such, the packing element 104 may be formed from a non-swellable material. The non-swellable material may include a metallic material, an elastomeric material, or a thermoplastic material. The process of mechanically setting the packing element 104 is further described herein.

The packer system 100 may further include multiple rings. For example, the packer system 100 may include a first inner grooved C-ring 106 and a second inner grooved C-ring 108. The packer system 100 may also include a first outer grooved C-ring 110 and a second outer grooved C-ring 112. The first inner grooved C-ring 106 and the first outer grooved C-ring 110 may be positioned on a first or uphole side of the packing element 104 while the second inner grooved C-ring 108 and the second outer grooved C-ring 112 may be positioned on a second or downhole side of the packing element 104.

The packer system 100 may include a first keyed inner wedge ring 114 on an uphole side of the packing element 104 and a second keyed inner wedge ring 116 on a downhole side of the packing element 104. The inner wedge rings 114, 116 may have a circumferential gap defined therein to enable the insertion of the line 180 into an interior of the wedge rings 114, 116. A first inner wedge ring key 118 (shown in FIG. 2) may correspond to a gap in the first keyed inner wedge ring 114 and may be inserted into the gap after the line 180 has been installed to complete the first keyed inner wedge ring 114 and to provide structural support thereto. Likewise, a second inner wedge ring key 120 (shown in FIG. 2) may correspond to a gap in the second keyed inner wedge ring 116 and may be inserted into the gap to complete the second keyed inner wedge ring 116.

The packer system 100 may further include a first wedge C-ring 122 positioned uphole to the packing element 104 and a second wedge C-ring 124 positioned downhole to the packing element 104. During installation and setting, each of the uphole rings 106, 110, 114, 122 may be compressed and may, thereby, engage each other to expand the packing element 104 from an uphole side. Likewise, each of the downhole rings 108, 112, 116, 124 may be compressed and may engage each other to expand the packing element 104 from a downhole side. Thus, rather than swelling, the packing element 104 may be expanded mechanically. Expansion of the packing element 104 is further described herein.

The packer system 100 may also include a keyed gauge ring 126. The keyed gauge ring 126 may engage the first wedge C-ring 122 uphole from the packing element 104. The keyed gauge ring 126 may also include a gap defined therein to enable installation of the line 180 within the keyed gauge ring 126 after the packer system 100 is assembled. A first gauge ring key 128 (shown in FIG. 2*s*) may correspond to a gap in the keyed gauge ring 126 and may be inserted into the gap to complete the keyed gauge ring 126 and provide structural support thereto.

The number, shape, size, and/or configurations of the ring elements is shown for illustrative purposes only and may be varied depending on the application as would be appreciated by one of ordinary skill in the art having the benefit of this disclosure. As used herein, a "first ring" comprises any element configured to be positioned around the mandrel 152 on a first side of the packer element 104 and a "second ring" comprises any element configured to be positioned around the mandrel 152 on a second side of the packer element 104.

The packer system 100 may include a mandrel 152 and a housing 154. The housing 154 may also be referred to as a push wedge ring. The mandrel 152 and the housing 154 may be coupled to additional string elements (not shown) which may in turn attach to a tool for use within the wellbore. A second gauge ring key 156 (shown in FIG. 2) may correspond to the housing 154 and may be inserted into a gap or groove 162 (shown in FIG. 2) defined therein that enables the line 180 to pass from an interior of the housing 154 to an exterior of the housing 154 as described herein.

Thus, the line 180 may pass within an interior of the packer system 100 and over an exterior of the mandrel 152. The line may be continuous, having no splices at least along the length of the mandrel 152. In some embodiments, the line is continuous, having no splices from a surface of the wellbore to a tool attached to the end of the mandrel 152 or to a tool attached to a string attached to the end of the packer system 100. The line may be a pneumatic line, an electrical line, an optical line, or another type of line capable of control or communication.

Figure 2:
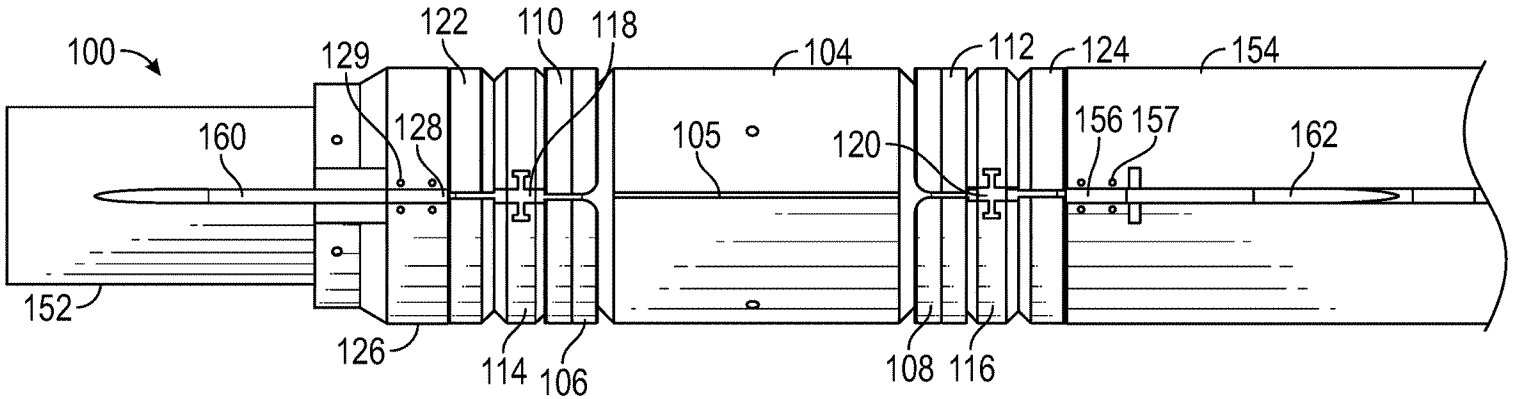
FIG. 2 is a schematic drawing depicting a top view of an embodiment of a mechanically-set packer system for use in a wellbore.

Referring to FIG. 2, a top view of an embodiment of a mechanically-set packer system 100 for use in a wellbore is depicted. While FIG. 2 does not depict the line 180 for clarity, various features are depicted that enable the line 180 to pass within an interior of the packer system 100 and ultimately to an exterior of the housing 154 are shown.

As seen in FIG. 2, the mandrel 152 may include a longitudinal recess 160 defined in the exterior thereof. The longitudinal recess 160 may be configured to receive the line 180 therein, which is not shown in FIG. 3 for clarity. The longitudinal recess 160 may retain the line 180 to prevent axial slippage and to prevent the line from interfering with the operation of the packer system 100. Although FIG. 2 depicts the longitudinal recess 160 as running along a limited portion of the length of the mandrel 152, in some embodiments, the longitudinal recess 160 may run along the full length of the mandrel 152.

FIG. 2 also depicts that the keys 118, 120, 128, 156 have been inserted into their respective keyed rings 114, 116, 126, 154. Before the keys 118, 120, 128, 156 are inserted, the keyed rings 114, 116, 126, 154 may have a gap that enables the line 180 to be pass from an exterior to an interior of the keyed rings 114, 116, 126, 154. The C-rings 106, 108, 110, 112, 122, 124 may also include gaps that enable the insertion of the line 180. These rings, however, may not be keyed in order to allow for radial expansion. Instead, the rings may include a gap that permits both the radial expansion of the ring as well as removal of the ring component from off the line 180 as discussed in the above referenced related applications.

The gaps in each of the keyed rings 114, 116, 126, 154, and in each of the C-rings 106, 108, 110, 112, 122, 124 may enable individual rings to be removed from their position on the mandrel 152 without affecting the remaining rings, such as for replacement or upgrading purposes. The line 180 may likewise be inserted or removed from rings individually. Other advantages of the gaps may exist.

In some embodiments, one or more fasteners may be used to retain the keys 118, 120, 128, 156. For example, FIG. 2 depicts one or more fasteners 129 locking the key 128 into place. Likewise, one or more fasteners 157 may lock the key 156 into place. Alternatively, other retention mechanisms may be used to lock the keys 118, 120, 128, 156 into place, such as interference fits, glue, welding, other attachment mechanism, or any combinations thereof.

The housing 154 may include a groove 162 defined therein. The groove 162 may provide a pathway for the line 180 to pass from an interior of the housing 154 to an exterior of the housing 154. The key 156 may close off the groove 162, thereby locking in the line 180 and providing structural support for the housing 154.

As shown in FIG. 2, in some embodiments, the packing element 104 may include a cut 105 to enable the line 180 to be installed within an interior of the packing element 104. The cut 105 may be a longitudinal cut across the length of the packing element 104 or the cut may have other shapes, such as a spiral shape or other patterned shape. In other embodiments, the packing element 104 may be cut by a technician assembling the packer assembly 104. Yet in other embodiments, the packing element 104 may be threaded onto the line 180 before assembly.

Figure 3:
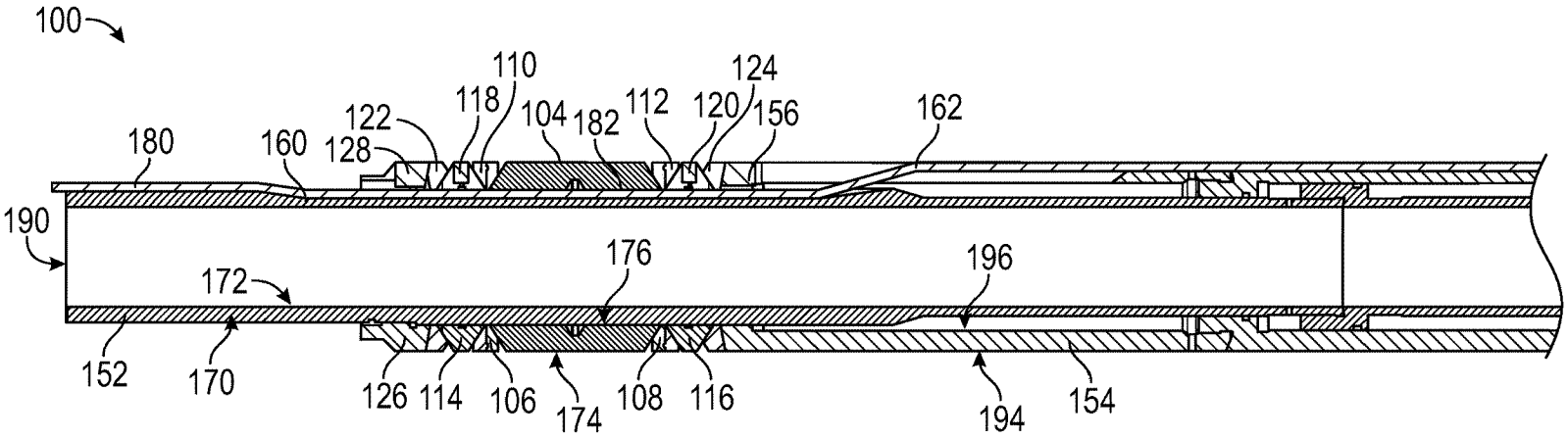
FIGS. 3 and 4 are schematic drawings depicting sectional views of an embodiment of a mechanically-set packer system for use in a wellbore.
Figure 4:
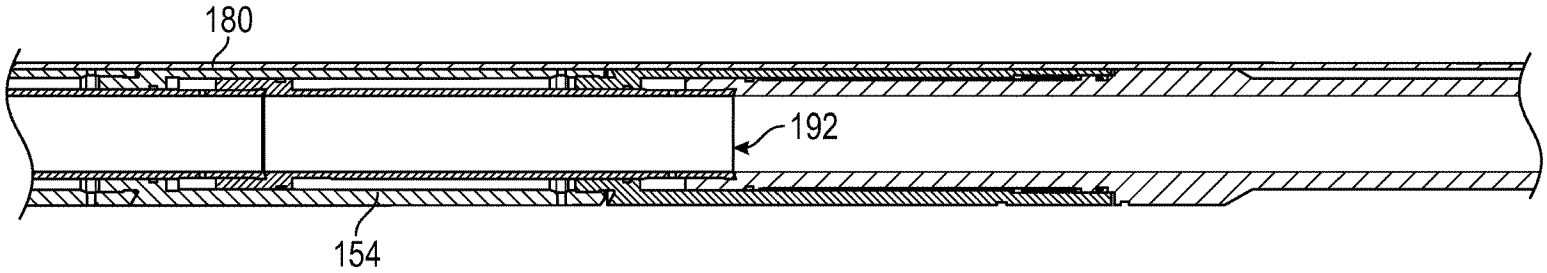

Referring to FIGS. 3 and 4, sectional views of an embodiment of a mechanically-set packer system 100 for use in a wellbore are depicted. As shown in FIG. 3, the mandrel 152 may include an exterior 170 and an interior 172. The line 180 may run along the exterior 170 of the mandrel 152. The packing element 104 may also include an exterior 174 and an interior 176. The line 180 may be positioned between the exterior 170 of the mandrel 152 and the interior 176 of the packing element 104. The line may further be positioned between an interior of each of the rings 106, 108, 110, 112, 114, 116, 122, 124, 126 and the mandrel 152. The keys 118, 120, 128, 156 may cover the line 180 retaining it in its position within the interior of the packing assembly 102.

A cover 182 may be positioned over the line 180 between the packing element 104 and the mandrel 152. The cover 182 may include a metallic material, an elastomeric material, a thermoplastic material, or a combination thereof. The cover 182 may assist with forming a seal with the packing element 104 against the line 180 when the packer assembly 102 is expanded and set.

The housing 154 may include an exterior 194 and an interior 196. As depicted, the groove 162 may pass through the housing 154 providing a pathway for the line 180. The line 180 may pass through the groove 162 from the interior 196 of the housing 154 to the exterior 194 of the housing 154. From there, the line 180 may pass to a tool (not shown) attached to the housing 154.

The mandrel 152 may include a first end 190, shown in FIG. 3, and a second end 192, shown in FIG. 4. The line 180 may pass from the first end 190 to the second end 192 without any splices. An advantage of passing the length of the mandrel 152 without any splices is that better communication through the line 180 may be enabled without interruption during the installation of the packer assembly 102. Other advantages may exist.

Figure 5:
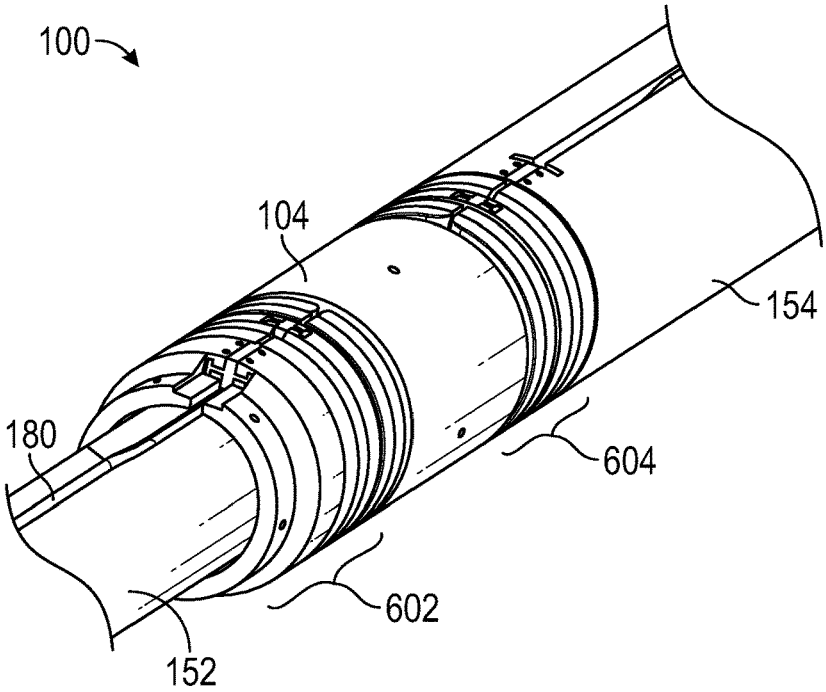
FIG. 5 is a schematic drawing depicting an isometric view of an embodiment of a mechanically-set packer system for use in a wellbore is depicted.

Referring to FIG. 5, an isometric view of an embodiment of a mechanically-set packer system 100 for use in a wellbore is depicted. In FIG. 5, the packer system 100 is shown as being unset. FIG. 5 depicts a first set of rings 602 and a second set of rings 604. The first set of rings 602 may include the first inner grooved C-ring 106, the first outer grooved C-ring 110, the first keyed inner wedge ring 114, the first wedge C-ring 122, and the keyed gauge ring 126. The second set of rings 604 may include the second inner grooved C-ring 108, the second outer grooved C-ring 112, the second keyed inner wedge ring 116, and the second wedge C-ring 124.

Figure 6:
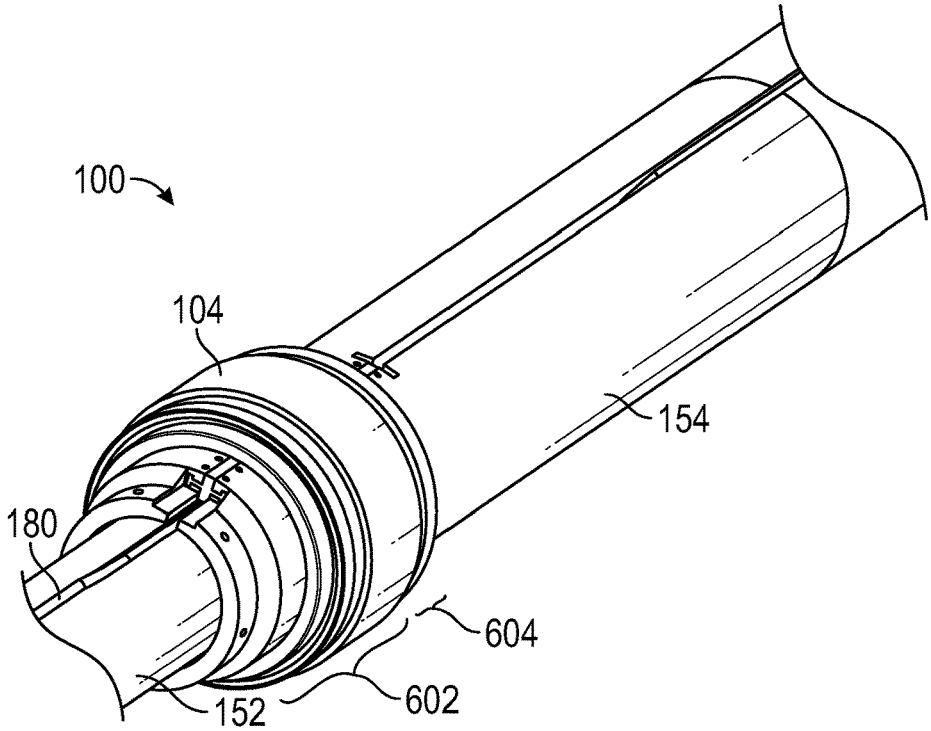
FIG. 6 is a schematic drawing depicting an isometric view of an embodiment of a mechanically-set packer system for use in a wellbore.

Referring to FIG. 6, an isometric view of an embodiment of a mechanically-set packer system 100 for use in a wellbore is depicted. In FIG. 6, the packer system 100 is shown as being set. In order to form a seal with the wellbore, the packer system 100 may be mechanically actuated to move the packing element 104 from an unset or unexpanded state (shown in FIG. 5) to a set or expanded state (shown in FIG. 6). In the set state, the first set of rings 602 and the second set of rings 604 may be compressed and may interact with each other to create an expansion force on the packing element 104. The compression may include weight-set compression, hydraulic-set compression, or hydrostatic-set compression. As a result of the compression, the packing element 104 may be expanded to form a seal with a wall of a wellbore. The packing element 104 may also form a seal with the mandrel 152 and the line 180 positioned between the mandrel 152 and the packing element 104.

Figure 7:
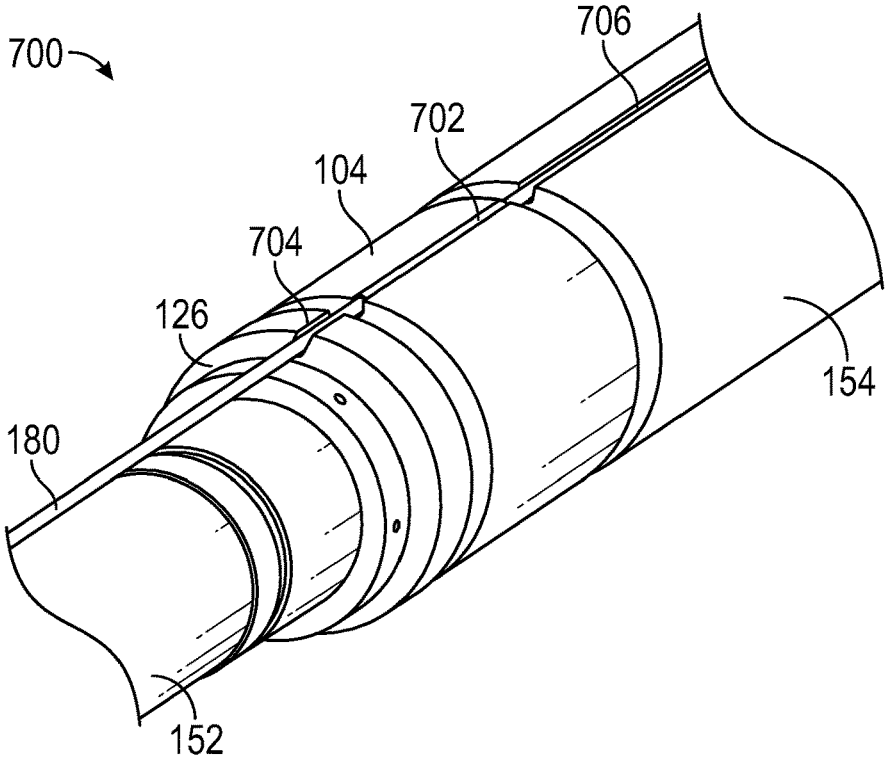
FIG. 7 is a schematic drawing depicting an isometric view of an embodiment of a mechanically-set packer system for use in a wellbore.

Referring to FIG. 7, an isometric view of an embodiment of a mechanically-set packer system 700 for use in a wellbore is depicted. The system 700 may include a packing element 104, a gauge ring 126, a housing 154, and a mandrel 152. As shown in FIG. 7, the packing element 104 may include a recess 702 defined therein. The packing element 104 may include a longitudinal slit that enables the line 180 to be inserted into the packing element 104. When the packing element is mechanically-set, or expanded, the longitudinal slit may compress around the line 180 forming a tight seal. The gauge ring 126 may include a groove 704 to receive the line 180 therein and, likewise, the housing 154 may include a groove 706 to receive the line 180 therein. In some embodiments, the system 700 may include additional rings. For example, the system 700 may include the first set of rings 602 and the second set of rings 604 described herein. An advantage of the system 700 is that by forming a seal around the line 180, the longitudinal slit 702 in the packing element 104 may enable the use of a continuous line, without any splices, for communication with a downhole tool. Other advantages may exist.

Figure 8:
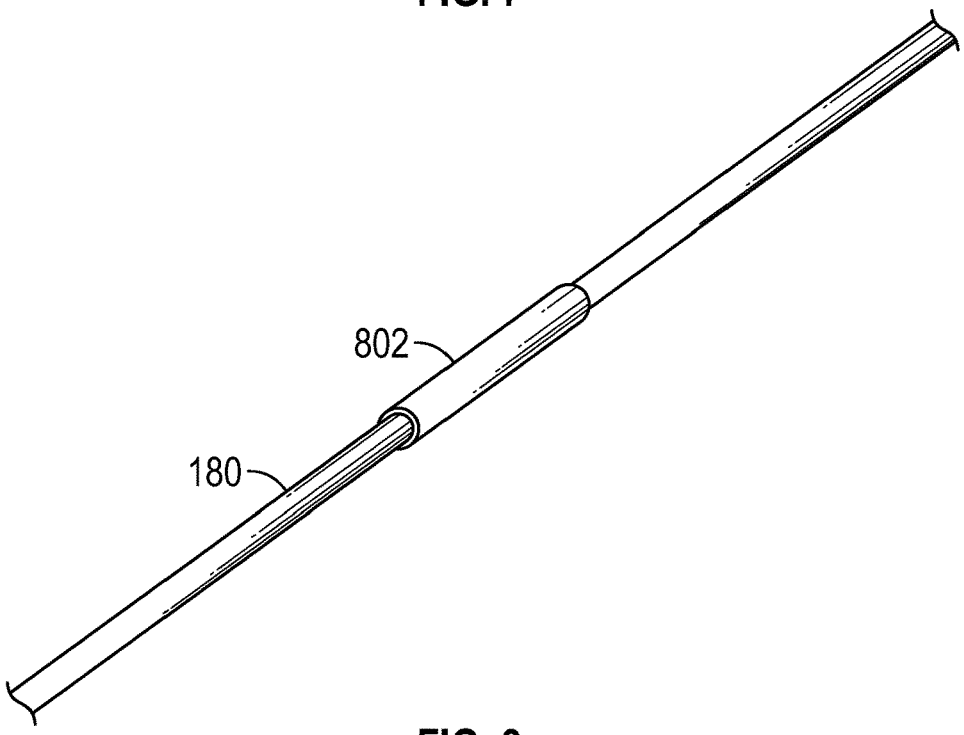
FIG. 8 is a schematic drawing depicting an isometric view of an embodiment of a line system for use with a mechanically-set packer system.

Referring to FIG. 8, an isometric view of an embodiment of a line assembly is depicted. The line assembly may include the line 180 and a sleeve 802 positioned over a portion of the line 180. The line assembly may be installed within the system 700. When the packer system 700 is set by expanding the packing element 104, the sleeve 802 and the packing element 104 may form a seal. The sleeve 802 may include a non-swellable material compatible with a material of the packing element 104. The sleeve 802 may enable the line 180 to form a better seal than a line that does not include a sleeve. The sleeve 802 may further be included in embodiments where the line 180 is positioned between an exterior of the mandrel 152 and an interior of the packing element 104. For example, the sleeve 802 may be coupled to the line 180 of FIGS. 1-6.

In some embodiments, the sleeve 802 may be configured to provide complete circumferential coverage along a portion of the line 180 as depicted in FIG. 8. Alternatively, the sleeve 802 may be configured to provide partial circumferential coverage along the portion of the line 180. For example, the sleeve 802 may cover only a bottom half, only a top half, or another portion of the line 180. The sleeve 802 may also include cuts to enable the sleeve 802 to be attached to the line 180. For example, the sleeve 802 may include a spiral cut to wrap around the line 180. Other cut patterns may also be used. In some embodiments, the sleeve 802 may comprise a single sleeve component. In other embodiments, the sleeve 802 may comprise multiple sleeve components that together form the sleeve 802.

Figure 9:
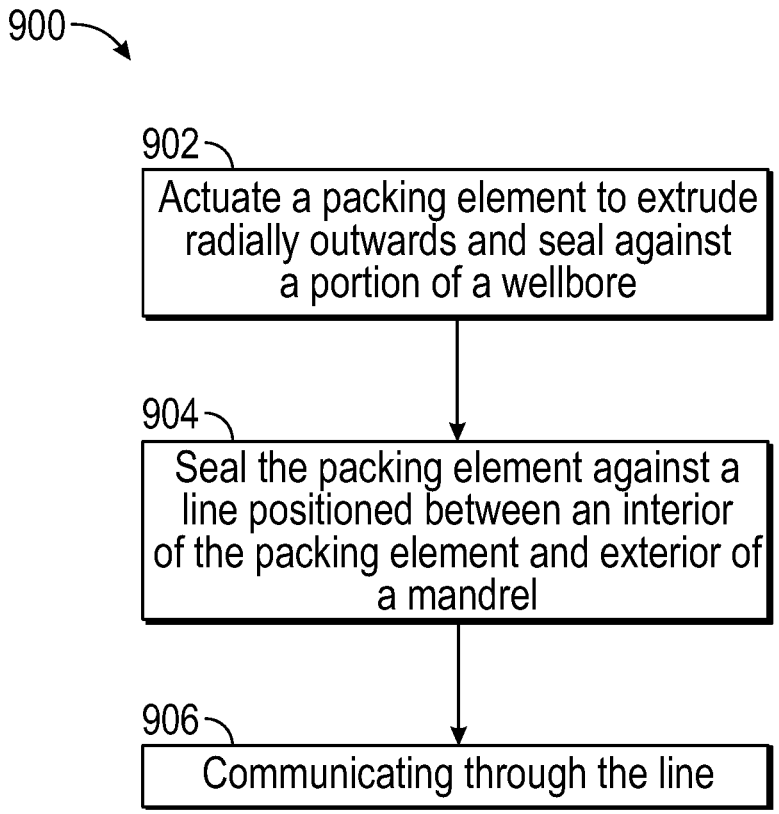
FIG. 9 is a flowchart depicting an embodiment of a method for using a mechanically-set packer to isolate different portions of a wellbore while enabling communication therebetween.

Referring to FIG. 9, an embodiment of a method for using a mechanically-set packer to isolate different portions of a wellbore while enabling communication therebetween is depicted. The method 900 may include actuating a packing element to cause the packing element to extrude radially outwards and seal against a portion of a wellbore, at 902. For example, the packing element 104 may be actuated to cause the packing element 104 to extrude radially and seal against a portion of a wellbore.

The method 900 may further include sealing the packing element against a line positioned between an interior of the packing element and an exterior of a mandrel, at 904. For example, the packing element 104 may be sealed against the line 180.

The method 900 may also include communicating through the line, at 906. For example, the line 180 may be used for communication, including sending control signals, between a surface of the wellbore and to a tool.

Although various embodiments have been shown and described, the present disclosure is not so limited and will be understood to include all such modifications and variations as would be apparent to one skilled in the art.

What claimed is:

1. A mechanically-set packer system for use in a wellbore environment, the system comprising:

a mandrel having an interior and an exterior, the mandrel having a longitudinal recess in the exterior of the mandrel, the longitudinal recess configured to receive a line therein;

a packing element having an exterior surface and an interior surface opposite of the exterior surface, the packing element positioned along the exterior of the mandrel;

a line positioned between the exterior of the mandrel and the interior surface of the packing element; and wherein the packing element includes a single cut from the exterior surface of the packing element to the interior surface of the packing element to enable the line to be installed from the exterior surface of the packing element to within the interior surface of the packing element and wherein the line is installed through the cut to be positioned between the exterior of the mandrel and the interior surface of the packing element.

2. The system of claim 1, wherein the packing element is formed of a non-swellable material.

3. The system of claim 2, wherein the non-swellable material includes a metallic material, an elastomeric material, or a thermoplastic material.

4. The system of claim 1, further comprising:

a cover positioned between at least a portion of the line and the interior of the packing element, the cover formed of a non-swellable material.

5. The system of claim 1, wherein the line is a pneumatic line, an electrical line, or an optical line.

6. The system of claim 1, wherein the line is continuous, without splices, from a surface location to a tool, the packing element being located between the surface location and the tool.

7. The system of claim 1, wherein the mandrel has a first end and a second end and wherein the line is continuous, without splices, from the first end to the second end.

8. The system of claim 1, further comprising:

at least one gauge ring positioned on the exterior of the mandrel, the at least one gauge ring connected to a first end of the packing element, the line positioned through a gap in the at least one gauge ring.

9. The system of claim 1, further comprising:

at least one C-ring positioned on the exterior of the mandrel, the at least one C-ring connected to a second end of the packing element the line positioned through a gap in the at least one C-ring.

10. The system of claim 1, wherein the wellbore environment is an open-hole wellbore.

11. The system of claim 1, further comprising a sleeve formed of a non-swellable material and configured to provide complete circumferential coverage for at least a portion of a line and to form a seal with the packing element.

12. A mechanically-set packer system for use in a wellbore environment, system comprising:

a mandrel having an interior and an exterior;

a packing element having an exterior surface and an interior surface opposite of the exterior surface, the packing element positioned on the exterior of the mandrel, wherein the mandrel and the packing element are configured to receive a line between the exterior of the mandrel and the interior surface of the packing element; and a cover positioned between at least a portion of the line and the interior surface of the packing element, wherein a seal is created between the cover and the packing element when the packing element is expanded and set.

13. The system of claim 12, wherein the packing element is formed of a non-swellable material.

14. The system of claim 13, wherein the non-swellable material includes a metallic material, an elastomeric material, or a thermoplastic material.

15. The system of claim 12, wherein the packing element includes a longitudinal cut to enable the line to be installed from along the exterior of the packing element to within the interior of the packing element.

16. The system of claim 15, further comprising:

a longitudinal recess in the exterior of the mandrel, the longitudinal recess configured to receive the line therein.

17. The system of claim 12, wherein the cover formed of a non-swellable material.

18. A mechanically-set packer system for use in a wellbore environment, the system comprising:

a mandrel having an interior and an exterior;

a packing element having an exterior surface and an interior surface opposite of the exterior surface, the packing element positioned along the exterior of the mandrel; and a protective sleeve formed of a non-swellable material and configured to provide complete circumferential coverage of at least a portion of a line, wherein the packing element includes a cut along the exterior surface to receive the line and the protective sleeve therethrough, the protective sleeve forming a seal with the packing element, wherein the protective sleeve is positioned between the interior surface of the packing element and the exterior of the mandrel and wherein the protective sleeve increases the sealability between the line and the packing element.

19. The system of claim 18, wherein the mandrel has a first end and a second end and wherein the line is continuous, without splices, from the first end to the second end.

20. The system of claim 18, wherein the protective sleeve includes a cut that enables the protective sleeve to be attached to the line.

21. A method for using a mechanically-set packer to isolate different portions of a wellbore while enabling communication therebetween, the method comprising:

actuating a packing element to cause the packing element to extrude radially outwards and seal against a portion of a wellbore, the packing element having an exterior surface and an interior surface opposite of the exterior surface;

providing a sleeve configured to provide complete circumferential coverage along a portion of a line positioned between the interior surface of the packing element and an exterior of a mandrel;

sealing the packing element against the sleeve positioned between the interior surface of the packing element and the exterior of a mandrel; and communicating through the line.

22. The method of claim 21, wherein the line is continuous, without splices, along the length of the mandrel.

23. The method of claim 21, wherein actuating the packing element includes applying weight-set compression, hydraulic-set compression, or hydrostatic-set compression to the packing element.

* * * * *